US007600647B2

(12) United States Patent
Strickler et al.

(10) Patent No.: US 7,600,647 B2
(45) Date of Patent: Oct. 13, 2009

(54) INFANT FEEDING CONTAINER

(75) Inventors: Robert W. Strickler, San Jose, CA (US); Daniel K. Harden, Palo Alto, CA (US)

(73) Assignee: Adiri, Inc., Palo Alto, CA (US)

( * ) Notice: Subject to any disclaimer, the term of this patent is extended or adjusted under 35 U.S.C. 154(b) by 234 days.

(21) Appl. No.: 11/539,572

(22) Filed: Oct. 6, 2006

(65) Prior Publication Data

US 2008/0083692 A1 Apr. 10, 2008

(51) Int. Cl.
*A61J 9/08* (2006.01)
*A61J 9/04* (2006.01)

(52) U.S. Cl. ..... 215/11.6; 215/11.1; 215/11.5

(58) Field of Classification Search ..... 215/11.1, 215/11.5, 11.6; 606/234, 236
See application file for complete search history.

(56) References Cited

U.S. PATENT DOCUMENTS 2,150,835 A * 3/1939 Kazimirow ..... 215/11.6
2,163,330 A * 6/1939 Snapp ..... 119/71
2,555,054 A * 5/1951 Oliver ..... 215/11.1
2,628,906 A * 2/1953 Horan ..... 426/117
2,907,485 A * 10/1959 Lunden ..... 215/11.1
3,112,837 A * 12/1963 Manoyian ..... 215/11.1
3,117,874 A * 1/1964 Horan ..... 426/117
3,193,125 A * 7/1965 Fischer ..... 215/11.1
3,394,018 A * 7/1968 Velonis et al. ..... 426/117
3,395,822 A * 8/1968 Donleavy ..... 215/11.3
3,507,666 A * 4/1970 Carbone et al. ..... 426/394
3,554,399 A * 1/1971 Chapman et al. ..... 215/11.6
3,593,870 A * 7/1971 Anderson ..... 215/11.5
3,966,869 A * 6/1976 Kohl ..... 264/242
5,690,679 A 11/1997 Prentiss
D404,825 S * 1/1999 Reed ..... D24/198
5,993,479 A 11/1999 Prentiss
6,032,810 A * 3/2000 Meyers et al. ..... 215/11.1
6,073,788 A * 6/2000 Stroud ..... 215/11.1
6,171,623 B1 * 1/2001 Gaylor et al. ..... 426/117
6,343,704 B1 2/2002 Prentiss
6,398,048 B1 * 6/2002 Kevorkian ..... 215/11.5

(Continued)

FOREIGN PATENT DOCUMENTS

CH 637896 A5 * 8/1983

(Continued)

OTHER PUBLICATIONS

International Search Report (9 pages).

(Continued)

*Primary Examiner*—Sue A Weaver
(74) *Attorney, Agent, or Firm*—Patent Law Group LLP; David C. Hsia

(57) ABSTRACT

An infant feeding container is disclosed to provide a feeding experience closely resembling natural breast feeding. The container includes a body, a lid for securing an open end of the body, and a cover for at least partially enclosing the body. The body has a pliant dome shaped portion that includes a ducted nipple, and a rigid cylindrical portion that defines extending form the dome shaped portion. The dome shaped portion provides soft and warm facial contact for an infant during feeding. The cylindrical portion provides a surface for a caretaker to easily grip the infant feeding container.

10 Claims, 5 Drawing Sheets

U.S. PATENT DOCUMENTS

| | | | | |
|---|---|---|---|---|
| 6,601,720 | B2 * | 8/2003 | Meyers et al. | 215/11.5 |
| 6,681,944 | B1 * | 1/2004 | Youssef et al. | 215/11.1 |
| 7,201,284 | B2 * | 4/2007 | Clark et al. | 215/11.5 |
| 2001/0015340 | A1 * | 8/2001 | Kolbel | 215/11.1 |
| 2003/0150890 | A1 * | 8/2003 | Perricone | 224/148.6 |
| 2005/0261738 | A1 * | 11/2005 | Garrett | 606/234 |
| 2006/0201901 | A1 * | 9/2006 | Sabree et al. | 215/11.1 |

FOREIGN PATENT DOCUMENTS

| | | | |
|---|---|---|---|
| FR | 974401 | A | 2/1951 |
| FR | 2595569 | A1 * | 9/1987 |
| FR | 2615729 | A1 * | 12/1988 |
| FR | 2873101 | A | 1/2006 |
| GB | 2003039 | A | 3/1979 |

OTHER PUBLICATIONS

International Preliminary Report on Patentability, 7 pages.

* cited by examiner

INFANT FEEDING CONTAINER

FIELD OF INVENTION

The present invention relates to infant feeding containers, more specifically to one which has the approximate form, feel, and function of a natural breast.

DESCRIPTION OF RELATED ART

It is widely known that natural breast feeding is the best way to nurture an infant. The quality of mother's milk is superior to prepared formulas and the act of providing an infant with the mother's warm breast and comfort is an important aspect of proper child development and bonding between mother and infant. However, artificial feeding systems may be desirable or necessary in some circumstances. These include medical situations such as premature births, mothers who have had mastectomies or who are unable to lactate sufficiently, infants who require dietary supplements, and health problems such as cleft pallet or breast abscesses. Social situations requiring artificial feeding include employed women who are unable to feed their infants at work, women who use breast pumps and require containers for feeding, the need to feed adopted infants, and other medical or social situations that may recommend the use of an artificial container.

Healthcare professionals agree that an infant's sensory experience is particularly important in the formative stages of development, and especially in the feeding process. While artificial feeding containers can never fully imitate a mother, the breast-like infant feeding containers disclosed in commonly assigned U.S. Pat. Nos. 5,690,679 and 5,993,479 provide a far more natural sensory experience for infants when artificial feeding means are needed.

Many of the baby bottles now in use may be cited for various shortcomings, the greatest being the unnaturalness of nursing from a rigid, angular, elongate container, often in contact with an infant's cheeks, chin, nose and hands. This results in a predominance of unnatural sensory experience that is inappropriate, particularly for newborn infants. Although artificial nipples are typically soft, they do not provide a sensory experience similar to the comforting feeling of breast feeding wherein an infant is often in full contact with the mother's soft, warm breast. Furthermore, rigid bottles can cause infants to ingest unnecessary amounts of air. While the latter issues are addressed by recent innovations in infant feeding systems, no existing container, other than the ones referenced in commonly assigned U.S. Pat. Nos. 5,690,679 and 5,993,479, offers the combination of form, feel and function comparable to natural breast feeding.

SUMMARY

In one embodiment of the invention, an infant feeding container comprises a body and a lid. The body has a pliant dome shaped portion that includes a ducted nipple for dispensing a liquid content. The body further has a rigid cylindrical portion that defines an open end for filling the infant feeding container with the liquid content. The dome shaped portion provides soft and warm facial contact for an infant during feeding. The cylindrical portion provides a surface for a caretaker to easily grip the infant feeding container. The lid secures the open end of the body.

BRIEF DESCRIPTION OF THE DRAWINGS

Use of the same reference numbers in different figures indicates similar or identical elements.

DETAILED DESCRIPTION

Figure 1:
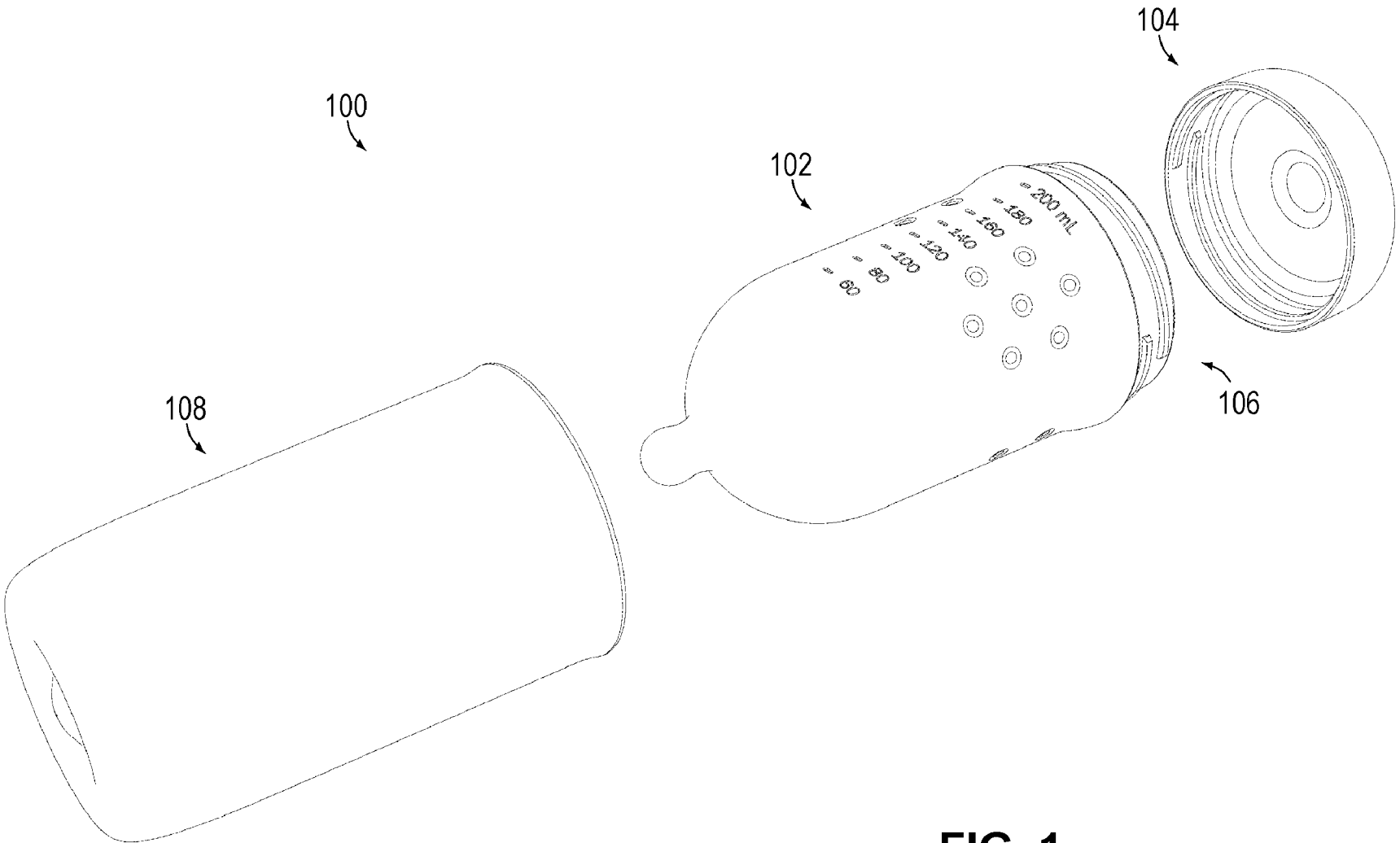
FIGS. 1 and 2 illustrate exploded views of an infant feeding container in one embodiment of the invention.
Figure 2:
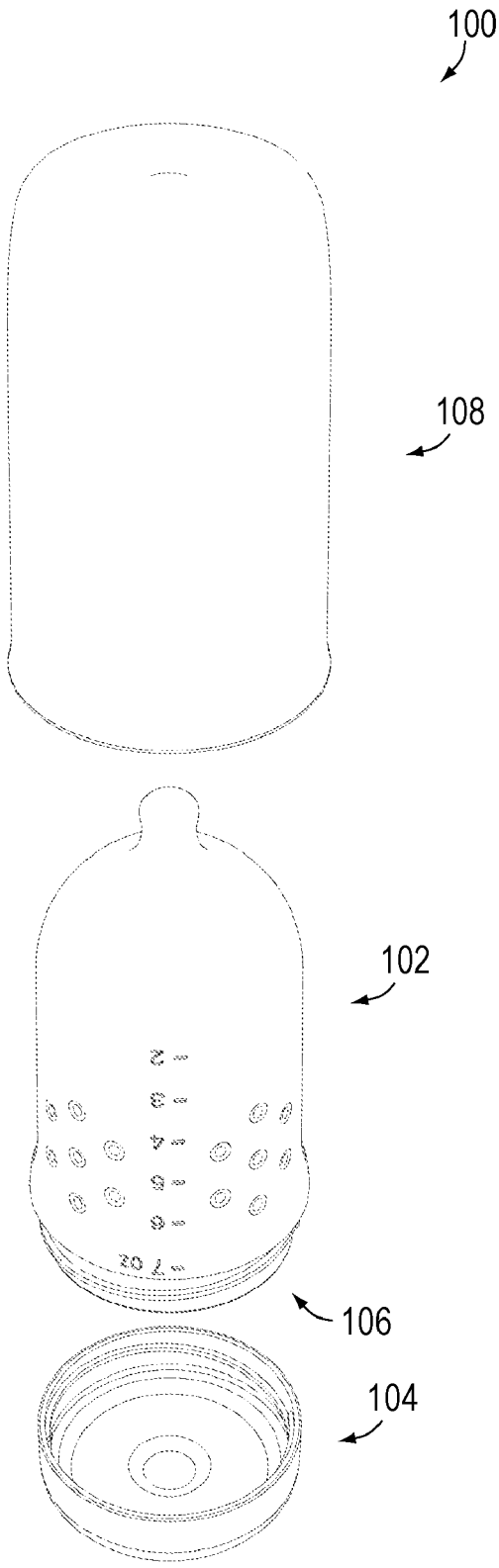

FIGS. 1 and 2 illustrate a baby feeding container 100 in one embodiment of the invention. Container 100 includes a bottle body 102, a lid 104 for securing an open end 106 of body 102, and a cover 108 for enclosing at least part of body 102. In one embodiment, body 102 and lid 104 are each an integral piece made in an over-mold process. In one embodiment, body 102 has a diameter of approximately 60 to 68 mm and a length of approximately 140 mm.

Figure 3:
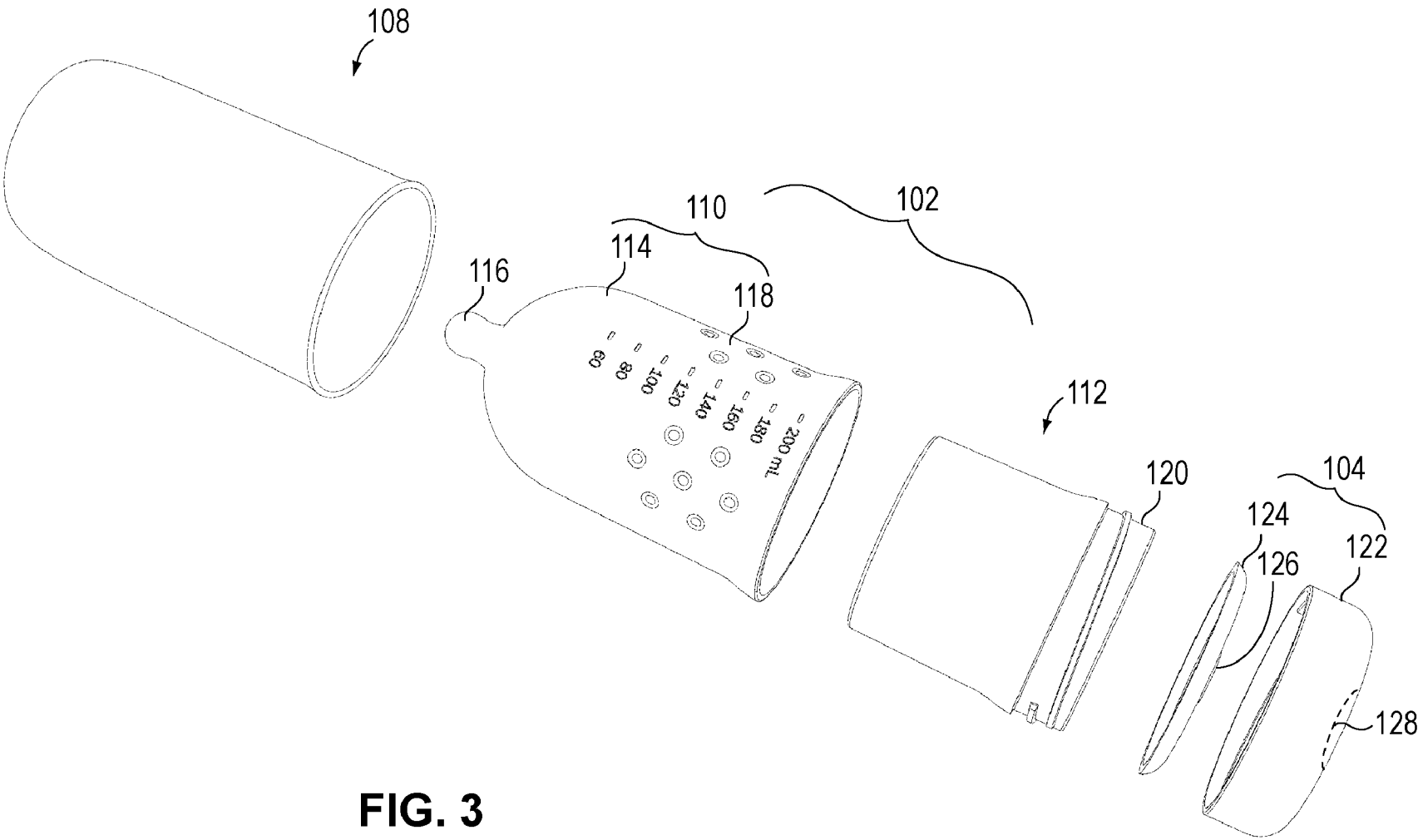
FIG. 3 illustrates an exploded view of the infant feeding container of FIGS. 1 and 2 where a bottle body and a lid are further broken down into their components in one embodiment of the invention.
Figure 4:
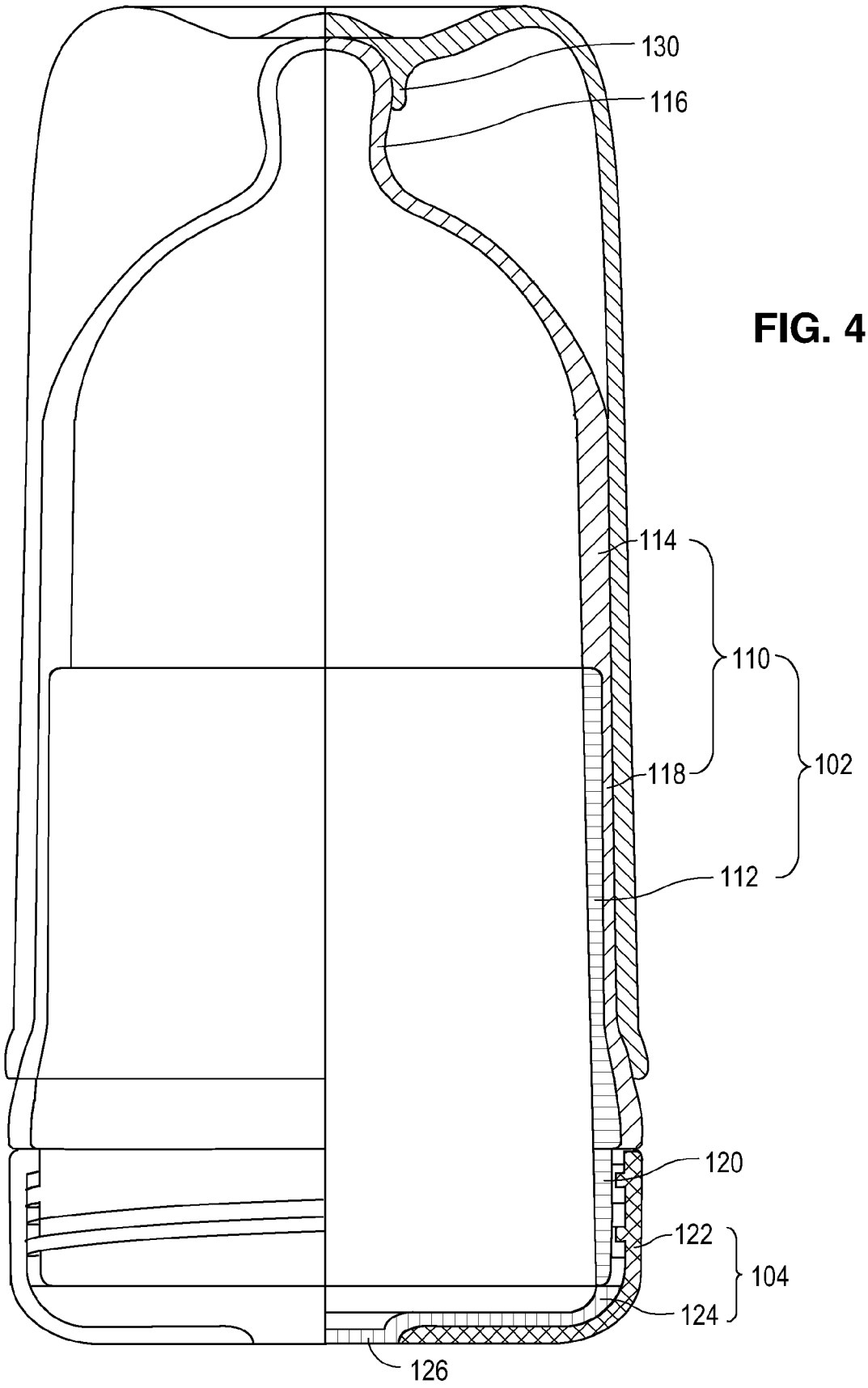
FIG. 4 illustrates a cross-section of the infant feeding container of FIGS. 1 and 2 in one embodiment of the invention.

FIGS. 3 and 4 illustrate container 100 where the components of body 102 and lid 104 are further labeled in one embodiment of the invention. Body 102 has a pliant over-mold 110 molded over a rigid substrate 112. Substrate 112 is first molded and then over-mold 110 is molded over substrate 112. Over-mold 110 has a dome shaped portion 114 with a ducted nipple 116 at the crest. Dome shaped portion 114 is not supported by substrate 112 so it remains pliant. Over-mold 110 further has a cylindrical portion 118 supported by substrate 112. Thus, cylindrical portion 118 has the shape of substrate 112. Over-mold 110 may be made from silicone, rubber, latex, thermoplastic elastomer, or another suitable pliant material. Substrate 112 is a cylinder with a threaded neck 120. Substrate 112 may be made from nylon, polycarbonate, polysulfone, or another suitable rigid material.

Dome shaped portion 114 is formed in the approximate shape of a breast. Dome shaped portion 114 is greater in size than a nipple on a conventional baby bottle. When filled with a warm liquid, dome shaped portion 114 provides soft and warm facial contact to an infant during feeding. This provides a feeding experience closely resembling natural breast feeding. In contrast, an infant feeding from a conventional baby bottle does not have warm and soft facial contact with the nipple or the bottle.

Cylindrical portion 118 over substrate 112 provides a rigid shape with a pliant surface that a caretaker can easily grip. The pliant nature of cylindrical portion 118 improves the overall grip on container 100. The surface of cylindrical portion 118 may be dimpled or otherwise patterned to further improve the grip on container 100. The surface of over-mold 110 may be marked to indicate the volume of the liquid content in container 100.

Lid 104 has a threaded screw cap 122 and a cap seal 124 located on the bottom surface of screw cap 122. Screw cap 122 is first molded and then cap seal 124 is molded into screw cap 122. Screw cap 122 may be made from nylon, polycarbonate, acrylic, or other suitable rigid material. Cap seal 124 may be made from thermoplastic elastomer or other suitable pliant material.

When screw cap 122 is screwed onto threaded neck 120 of substrate 112, the bottom of substrate 112 contacts cap seal 124 to securely seal the liquid contents of container 100. Cap seal 124 includes a vent 126 that allows air to enter container 100 as the liquid content exits container 100 through ducted nipple 116. Vent 126 protrudes outward from an opening 128 (shown in phantom in FIG. 3) in screw cap 122.

Cover 108 fits over the outer surface of body 102 to at least enclose dome shaped portion 114. Cover 108 has an inner surface that forms a cap 130 (FIG. 4) for engaging ducted nipple 116 to prevent the liquid content from leaking.

To fill container 100, the caretaker fits cover 108 over body 102 so that ducted nipple 116 is capped. The caretaker then turns body 102 upside down and fills it with the liquid content. Once filled, the caretaker screws lid 104 onto body 102.

Figure 5:
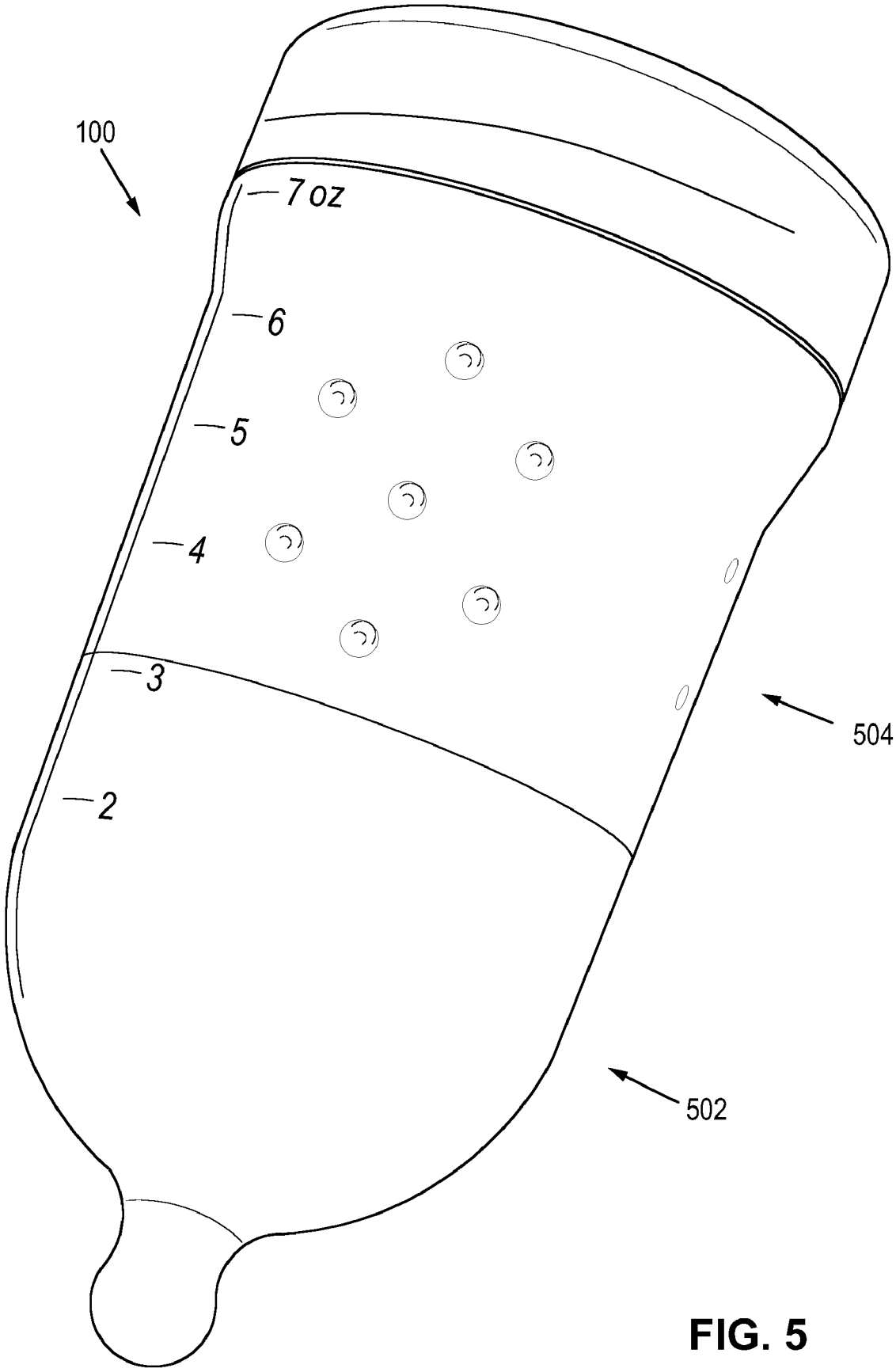
FIG. 5 illustrates a perspective view of the infant feeding container of FIGS. 1 and 2 in one embodiment of the invention.

FIG. 5 illustrates a view of the assembled container 100 in one embodiment. Container 100 essentially has a body with a pliant dome shaped portion 502 and a rigid cylindrical portion 504. As described above, pliant dome shaped portion 502 is formed from portion 114 of over-mold 110 unsupported by substrate 112 and rigid cylindrical portion 504 is formed from portion 118 of over-mold 110 supported by substrate 112.

Container 100 offers advantages over a conventional baby bottle. First, container 100 provides a more natural feeding experience. As described above, container 100 offers soft and warm facial contact during feeding that closely resembles natural breast feeding. Second, container 100 has fewer parts than a conventional baby bottle. As described above, container 100 consists of a bottle body with a nipple, a lid for securing an opening of the body, and a cover for the nipple. A conventional baby bottle often consists of a bottle, a nipple, a collar for securing the nipple to the bottle, a nipple plug that fits between the collar and the bottle, and a cover for the nipple.

Various other adaptations and combinations of features of the embodiments disclosed are within the scope of the invention. Numerous embodiments are encompassed by the following claims.

What is claimed is:

1. An infant feeding container for providing a feeding experience that closely resembles natural breast feeding, the infant feeding container comprising:

a body having:

a pliant dome shaped portion having a ducted nipple located at a crest of the dome shaped portion, the dome shaped portion providing soft and warm facial contact during feeding; and a rigid cylindrical portion having an open end, the cylindrical portion providing a surface for gripping the infant feeding container;

a lid for securing the open end of the body;

wherein the body is an over-molded integral piece comprising a rigid substrate and a pliant over-mold having a first portion unsupported by the substrate and a second portion molded over and supported by the substrate, the first portion of the over-mold forming the dome shaped portion, the second portion of the over-mold and the substrate forming the cylindrical portion.

2. The infant feeding container of claim 1, wherein the second portion of the over-mold forms a pliant surface over the substrate.

3. The infant feeding container of claim 1, wherein the lid is another over-molded integral piece comprising a cap and a cap seal molded into the cap.

4. The infant feeding container of claim 3, wherein the cap seal comprises a vent and protrudes through an opening in the cap.

5. The infant feeding container of claim 3, wherein the substrate comprises a threaded neck and the cap comprises a threaded screw cap for engaging the threaded neck.

6. The infant feeding container of claim 1, further comprising:

a cover for engaging an outer surface of the body.

7. The infant feeding container of claim 6, wherein the cover further comprises an inner surface that forms a cap for engaging the nipple to prevent liquid flow.

8. The infant feeding container of claim 1, wherein the cylindrical portion extends from the dome shaped portion and the cylindrical portion has substantially the same outer diameter as the base of the dome shaped portion.

9. The infant feeding container of claim 1, wherein the lid comprises a vent that allows air to enter the integral body when a liquid content exits through the ducted nipple.

10. An infant feeding container for providing a feeding experience that closely resembles natural breast feeding, the infant feeding container comprising:

a body comprising an over-molded piece, comprising:

a rigid cylindrical substrate having a threaded neck; and a pliant over-mold having a first portion unsupported by the substrate and a second portion molded over and supported by the substrate, the first portion of the over-mold comprising a pliant dome shaped portion having a ducted nipple, the second portion of the over-mold and the substrate forming a rigid cylindrical portion with a pliant surface;

a lid comprising another over-mold piece, comprising:

a threaded screw cap, the threaded screw cap defining an opening for a vent; and a cap seal in the threaded screw cap, the cap seal comprising the vent; and a cover for engaging an outer surface of the body, the cover comprising an inner surface that forms another cap for engaging the nipple to prevent liquid flow.

* * * * *